US009485582B2

(12) United States Patent
Tomizawa et al.

(10) Patent No.: US 9,485,582 B2
(45) Date of Patent: Nov. 1, 2016

(54) SPEAKER

(71) Applicant: JVC KENWOOD Corporation, Yokohama-shi, Kanagawa (JP)

(72) Inventors: Satoshi Tomizawa, Yokohama (JP); Yusuke Ishikawa, Yokohama (JP); Masao Nakayama, Yokohama (JP)

(73) Assignee: JVC KENWOOD CORPORATION, Yokohama-Shi, Kanagawa (JP)

( * ) Notice: Subject to any disclaimer, the term of this patent is extended or adjusted under 35 U.S.C. 154(b) by 0 days.

(21) Appl. No.: 14/792,705

(22) Filed: Jul. 7, 2015

(65) Prior Publication Data

US 2016/0021462 A1 Jan. 21, 2016

(30) Foreign Application Priority Data

Jul. 15, 2014 (JP) ..... 2014-144859

(51) Int. Cl.
*H04R 1/02* (2006.01)
*H04R 7/18* (2006.01)

(52) U.S. Cl.
CPC ..... *H04R 7/18* (2013.01); *H04R 2307/207* (2013.01)

(58) Field of Classification Search
CPC ..... H04R 7/16; H04R 7/18; H04R 7/20; H04R 9/025
See application file for complete search history.

(56) References Cited

U.S. PATENT DOCUMENTS

2009/0190793 A1* 7/2009 Kaiya ..... H04R 7/20 381/398

FOREIGN PATENT DOCUMENTS

JP 62-32698 U 2/1987

* cited by examiner

*Primary Examiner* — Tuan D Nguyen
(74) *Attorney, Agent, or Firm* — Nath, Goldberg & Meyer; Jerald L. Meyer

(57) ABSTRACT

An edge has an inner circumferential portion connected to an outer circumferential portion of a diaphragm, and is made of an annular elastic deformation member. A frame is connected to an outer circumferential portion of the edge, and supports the diaphragm through the edge. A magnetic circuit displaces the diaphragm in a first direction that is a sound emission direction and in a second direction that is an opposite direction to the sound emission direction, and vibrates the diaphragm. In a region between the inner circumferential portion and outer circumferential portion of the edge, the edge includes a rib, which is protruded in the second direction, and limits a stroke of the diaphragm in the second direction.

5 Claims, 7 Drawing Sheets

SPEAKER

CROSS REFERENCE TO RELATED APPLICATION

This application is based upon and claims the benefit of priority under 35U.S.C. §119 from Japanese Patent Application No. 2014-144859, filed on Jul. 15, 2014, the entire contents of which are incorporated herein by reference.

BACKGROUND

The present disclosure relates to a speaker such as a subwoofer.

Usually, a speaker is composed of: a cone-like diaphragm supported on a frame through an edge; a magnetic circuit that drives the diaphragm; and a damper.

The magnetic circuit includes: a voice coil wound around a voice coil bobbin fixed to an inner circumferential portion of the diaphragm; a plate fixed to the frame; a permanent magnet; and a yoke.

In general, one end side of the damper is fixed to the voice coil bobbin, and the other end side thereof is fixed to the frame. The diaphragm vibrates in such a manner that a current corresponding to an audio signal is applied to the voice coil. Usually, the edge and the damper have functions as suspensions for returning the diaphragm to a regular position.

The diaphragm vibrates in a sound emission direction and a direction opposite thereto. The diaphragm has such a merit of being capable of ensuring a sound pressure significantly to emit a good tone when a stroke of the diaphragm in a vibration direction is not limited. On the other hand, in a subwoofer or the like, which is a form of speaker, a stroke thereof is large, and accordingly, in particular, unless the stroke is limited in the direction opposite to the sound emission direction, then there is a possibility that the voice coil bobbin, the voice coil or the damper may collide with the permanent magnet or the yoke, and sound quality may be deteriorated, or the speaker may be broken.

In Japanese Unexamined Utility Model Application Publication No. S62-32698 (Patent Document 1), a speaker is described, which is configured so that the stroke in the direction opposite to the sound emission direction is limited by providing the frame with a protruding portion that limits deformation of the edge.

SUMMARY

However, in the speaker described in Patent Document 1, the edge made of a soft and thin elastic deformation member is likely to be damaged by colliding with the protruding portion of the hard frame many times.

It is an object of the embodiments to provide a speaker, which does not limit the stroke in the sound emission direction, but is capable of limiting the stroke in the direction opposite to the sound emission direction, and is capable of suppressing the damage of the edge.

An aspect of the embodiments provides a speaker including: a diaphragm; an edge, which has an inner circumferential portion connected to an outer circumferential portion of the diaphragm, and is made of an annular elastic deformation member; a frame, which is connected to an outer circumferential portion of the edge, and supports the diaphragm through the edge; a magnetic circuit, which displaces the diaphragm in a first direction that is a sound emission direction and in a second direction that is an opposite direction to the sound emission direction, and vibrates the diaphragm, and at least one rib, which is protruded in the second direction, and limits a stroke of the diaphragm in the second direction, the rib being provided in a region between the inner circumferential portion and outer circumferential portion of the edge.

DETAILED DESCRIPTION

<First Embodiment>

A description is made of a speaker of the first embodiment by using FIG. 1 to FIG. 4.

Figure 1:
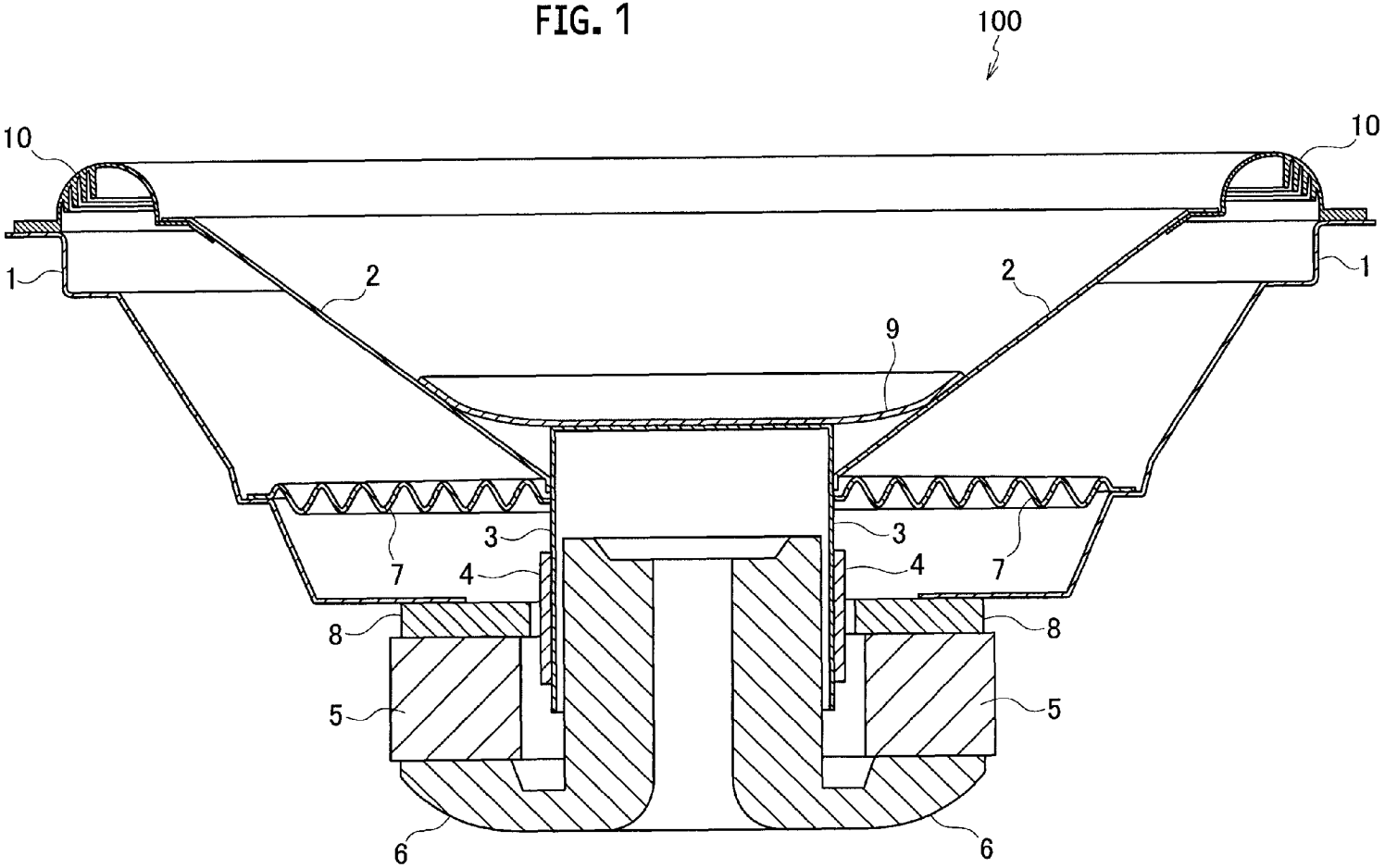
FIG. 1 is a cross-sectional view showing speakers of the first to third embodiments.

As shown in FIG. 1, a speaker 100 is composed by including a frame 1, a diaphragm 2, a voice coil bobbin 3, a voice coil 4, a permanent magnet 5, a yoke 6, a damper 7, a plate 8, a cap 9, and an edge 10.

The voice coil 4, the permanent magnet 5, the plate 8 and the yoke 6 compose a magnetic circuit that vibrates the diaphragm 2. The voice coil 4 is arranged in a gap portion of the magnetic circuit.

The frame 1 is made of metal, and supports the diaphragm 2 through the edge 10.

The diaphragm has a cone shape. Moreover, in the diaphragm 2, an outer circumferential portion thereof is firmly fixed to the edge 10, and an inner circumferential portion thereof is fixed to the voice coil bobbin 3. Furthermore, to the inner circumferential portion of the diaphragm 2, the cap 9 is firmly fixed so as to cover the voice coil bobbin 3.

The edge 10 is an annular elastic deformation member that couples the diaphragm 2 and the frame 1 to each other so that the diaphragm 2 and the frame 1 can be freely deformable.

The voice coil bobbin 3 has a cylindrical shape, and is fixed to the center portion of the diaphragm 2.

The voice coil 4 is wound around an outer circumferential portion of the voice coil bobbin 3, and functions as an electromagnetic coil.

The permanent magnet 5 and the yoke 6 are arranged in a vicinity of the voice coil 4.

In the first embodiment, in the vicinity of the voice coil 4, the permanent magnet 5 is arranged on an outside of the voice coil bobbin 3, and the yoke 6 is arranged in the inside of the voice coil bobbin 3.

The plate 8 is fixed onto the permanent magnet 5. To the plate 8, a lower end portion of the frame 1 is fixed.

The voice coil 4 and the permanent magnet 5 and the plate 8 are arranged so that the voice coil 4 is opposed to the permanent magnet 5 and the plate 8 while having a gap therebetween. Moreover, the voice coil bobbin 3 and the yoke 6 are arranged so as to be opposed to each other while having a gap therebetween.

The damper 7 is made of an elastic deformation member, and couples the voice coil bobbin 3 and the frame 1 to each other so that the voice coil bobbin 3 and the frame 1 can be freely deformed. Note that the damper 7 may couple the diaphragm 2 and the frame 1 to each other so that the diaphragm 2 and the frame 1 can be freely deformed.

Hence, together with the voice coil bobbin 3 and the voice coil 4, the diaphragm 2 is supported on the frame 1 though the edge 10 and the damper 7, which are made of the elastic deformation members.

The edge 10 and the damper 7 function as suspensions which support the diaphragm 2.

When the voice coil 4 is supplied with a current, which corresponds to an audio signal, from the outside, a current flows in a static magnetic field formed by the magnetic circuit, and accordingly, force in accordance with Fleming's left-hand rule is generated in the voice coil 4. By this force, the diaphragm 2 vibrates in the vertical direction together with the voice coil bobbin 3 and the voice coil 4.

The vertical direction is a crosswise direction in FIG. 1. An upper direction (left direction of FIG. 1) of the speaker 100 is a sound emission direction (first direction) where the diaphragm 2 emits sounds.

Figure 2:
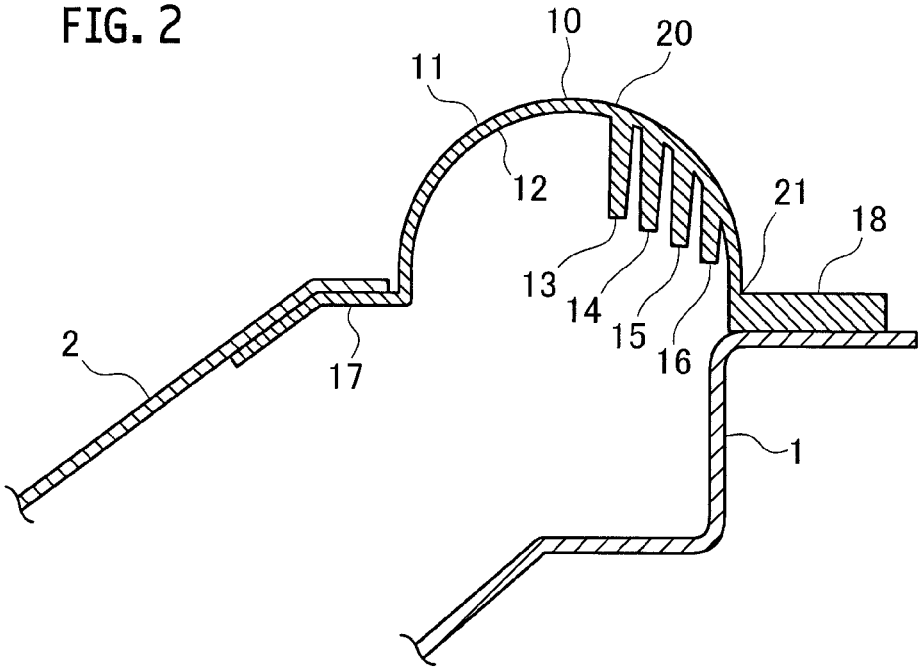
FIG. 2 is a cross-sectional view showing an edge in the speaker of the first embodiment.
Figure 3:
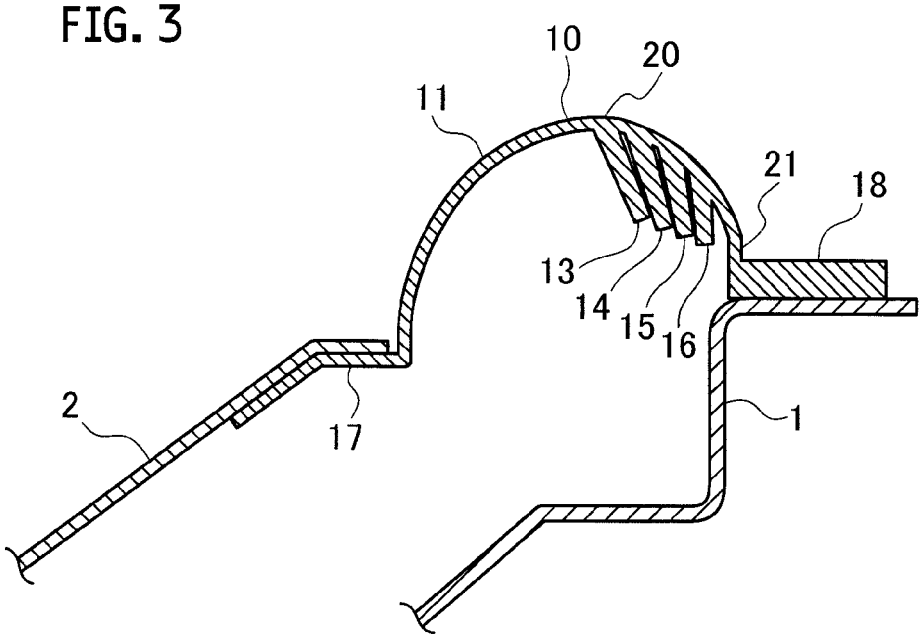
FIG. 3 is a cross-sectional view showing a deformed state of the edge when a diaphragm shown in FIG. 2 vibrates in a direction opposite to a sound emission direction.
Figure 4:
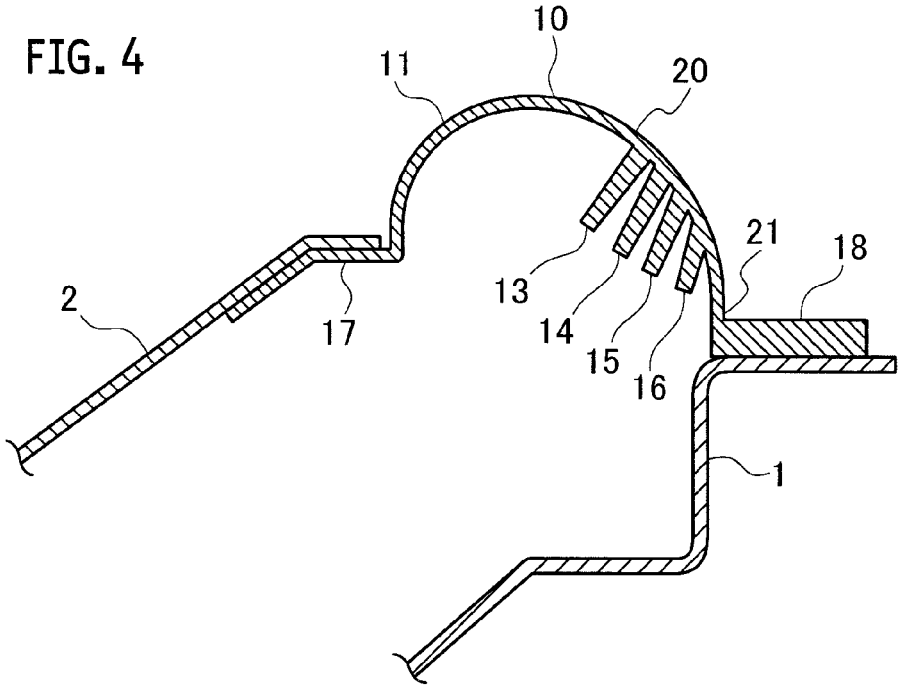
FIG. 4 is a cross-sectional view showing a deformed state of the edge when the diaphragm shown in FIG. 2 vibrates in the sound emission direction.

Here, a description follows of the edge 10 in detail by using FIG. 2 to FIG. 4.

As shown in FIG. 2, the edge 10 includes: a circular arc portion 11 having a circular arc cross-sectional shape protruding to a sound emission side; an edge inner circumferential portion 17, which is formed on one end side of the circular arc portion 11 and is connected to the outer circumferential portion of the diaphragm 2; and an edge outer circumferential portion 18, which is formed on the other end side of the circular arc portion 11 and is connected to the frame 1. On an inner recessed surface 12 of the circular arc portion 11, there are formed a plurality of ribs 13 to 16 protruding in an opposite direction (second direction) to the sound emission direction.

The circular arc portion 11, the ribs 13 to 16, the edge inner circumferential portion 17 and the outer circumferential portion 18 can be fabricated by integrally molding an elastic deformation member common thereto.

The ribs 13 to 16 are arranged in line in a radial direction (direction of separating from a center of the diaphragm 2) of the edge 10 (diaphragm 2).

Moreover, the ribs 13 to 16 may be individually formed into an annular shape along the annular edge 10 over an entire circumference thereof, or may be intermittently formed only on specific locations going along the annular edge 10.

Positions of the ribs 13 to 16 with respect to the radial direction of the diaphragm 2 are not particularly limited. It is preferable that the ribs 13 to 16 are less likely to affect sound quality, and the ribs 13 to 16 gradually limit the stroke in the opposite direction to the sound emission direction. Therefore, it is preferable that the ribs 13 to 16 are arranged in a region apart from the center of the diaphragm 2 on the inner recessed surface 12 of the circular arc portion 11.

Moreover, as a cross-sectional shape of the ribs 13 to 16, any shape such as a trapezoid, a rectangle, a triangle, an ellipsoid and the like is applicable, and the cross-sectional shape of the ribs 13 to 16 is not particularly limited. In the first embodiment, as the cross-sectional shape of the ribs 13 to 16, a trapezoidal shape is applied, in which the inner recessed surface 12 side of the circular arc portion 11 is wide, and a tip end side is narrow.

By using FIG. 2 and FIG. 3, next follows a description of a deformed state of the edge 10 when the diaphragm 2 is displaced in the opposite direction to the sound emission direction. FIG. 2 shows a usual state of the edge 10 when the diaphragm 2 does not vibrate. FIG. 3 shows a deformed state of the edge 10 when the diaphragm 2 vibrates and is displaced in the opposite direction to the sound emission direction.

When the diaphragm 2 starts to be displaced in the opposite direction to the sound emission direction, a stress is concentrated on a connection spot 20 of the edge 10 to the circular arc portion 11 on an inner circumferential side of the rib 13. Therefore, the edge 10 is deformed around the connection spot 20 serving as a fulcrum, and in addition, the rib 13 makes contact with the rib 14 adjacent thereto. The rib 13 makes contact with the rib 14, whereby such a deformation of the edge 10 is slightly suppressed, and accordingly, the stroke in the opposite direction to the sound emission direction is slightly suppressed.

When the diaphragm 2 continues to be displaced in the opposite direction to the sound emission direction, the edge 10 is further deformed around the connection spot 20 serving as a fulcrum, and the rib 14 makes contact with the rib 15 adjacent thereto, and accordingly, the stroke in the opposite direction to the sound emission direction is further suppressed.

Then, when the diaphragm 2 is further displaced in the opposite direction to the sound emission direction, the edge 10 is further deformed around the connection spot 20 serving as a fulcrum, and the rib 15 makes contact with the rib 16 adjacent thereto, and accordingly, the stroke in the opposite direction to the sound emission direction is further suppressed. The rib 15 makes contact with the rib 16, whereby the deformation of the edge 10 is further suppressed, and accordingly, the stroke in the opposite direction to the sound emission direction is further suppressed.

The ribs 13 to 16 sequentially make contact with one another as the diaphragm 2 is displaced in the opposite direction to the sound emission direction, whereby it is possible to gradually limit the stroke in the opposite direction to the sound emission direction of the diaphragm 2.

That is to say, the ribs 13 to 16 are configured so that a degree of limiting the stroke of the diaphragm 2 can be greater as a degree at which the diaphragm 2 is displaced in the opposite direction to the sound emission direction becomes greater.

A length (length from the inner recessed surface 12 of the circular arc portion 11 to the tip end) of each of the ribs 13 to 16 and a pitch between the ribs are not particularly limited; however, it is preferable that positions of the tip ends should not coincide with one another when the ribs 13, 14, 15 and 16 make contact with one another. The positions here are positions in a direction that goes along a vibration direction of the diaphragm 2. When the positions of the tip ends of the ribs 13 to 16 coincide with one another, the stress is concentrated on the tip ends of the ribs 13 to 16 as the diaphragm 2 is being displaced in the opposite direction to the sound emission direction.

On the contrary, the length of each of the ribs 13 to 16 and the pitch between the ribs are set so that the positions of the tip ends of the ribs 13 to 16 cannot coincide with one another, whereby the stress can be dispersed even when the diaphragm 2 is displaced in the opposite direction to the sound emission direction. That is to say, the stress generated by the deformation of the edge 10 is dispersed by the ribs 13 to 16, and accordingly, a degree of freedom in design, which is against a material fracture of the ribs, is enhanced.

In the first embodiment, the length of each of the ribs 13 to 16 and the pitch therebetween are set so that, in a case where the diaphragm 2 is displaced in the opposite direction to the sound emission direction, the tip end of the rib 13 makes contact with the adjacent-side surface of the rib 14, the tip end of the rib 14 makes contact with the adjacent-side surface of the rib 15, and the tip end of the rib 15 makes contact with the adjacent-side surface of the rib 16.

Moreover, the corners of trapezoidal tip end portions of the ribs 13 to 16 are formed into a rounding shape, whereby the stress applied to the corners of the trapezoidal tip end portions can be further dispersed.

By using FIG. 2 and FIG. 4, next follows a description of a deformed state of the edge 10 when the diaphragm 2 vibrates in the sound emission direction. FIG. 4 shows the deformed state of the edge 10 when the diaphragm 2 vibrates in the sound emission direction.

When the diaphragm 2 is displaced in the sound emission direction, the stress is concentrated on a connection spot 21 between the circular arc portion 11 of the edge 10 and the frame 1, and accordingly, the edge 10 is deformed around the connection spot 21 serving as a fulcrum, and in addition, the edge 10 is deformed in a direction where the tip ends of the ribs 13, 14, 15 and 16 separate from one another.

Hence, in a case where the diaphragm 2 is displaced in the sound emission direction, the ribs 13 to 16 do not make contact with one another. Therefore, the stroke in the sound emission direction is not affected by the limitations of the ribs 13 to 16.

As described above, in accordance with the first embodiment, for the diaphragm 2, it is possible not to limit the stroke in the sound emission direction by the ribs 13 to 16, and to gradually limit the stroke in the opposite direction to the sound emission direction by the ribs 13 to 16.

Moreover, in accordance with the first embodiment, the ribs 13 to 16 which compose the edge 10 limit the stroke in the opposite direction to the sound emission direction, and accordingly, the edge 10 does not collides with the frame 1. Hence, damage of the edge 10, which is caused by the frame 1, can be suppressed.

Furthermore, the ribs 13 to 16 gradually limit the stroke, and accordingly, the stress applied to the edge 10 is dispersed. In such a way, damage to the material can also be reduced.

Moreover, in accordance with the first embodiment, it is possible for the ribs 13 to 16 to gradually limit the stroke in the opposite direction to the sound emission direction, and accordingly, a load applied to the damper 7 can be reduced.

In the first embodiment, since there is a possibility that the sound quality may be deteriorated to a large extent when the damper 7 vibrates to a stroke limitation thereof, and accordingly, such a design is made so that the stroke limitation of the damper 7 can become greater than a stroke limitation of the diaphragm 2.

Note that, in the first embodiment, a configuration in which the four ribs 13 to 16 are provided is adopted; however, the number of ribs is not particularly limited.

<Modification Example of First Embodiment>

Figure 5:
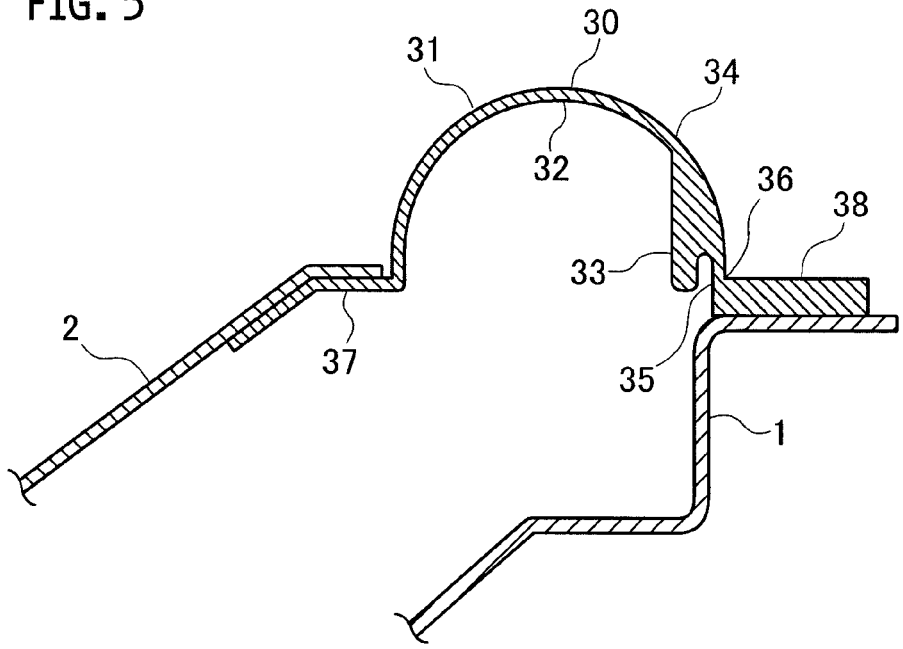
FIG. 5 is a cross-sectional view showing a modification example of the edge in the speaker of the first embodiment.

As a modification example of the first embodiment, a configuration in which the edge includes one rib is described below by using FIG. 5. FIG. 5 corresponds to FIG. 2 in the first embodiment.

In comparison with the speaker of the first embodiment, a speaker of the first modification example is different therefrom in a configuration of an edge 30, and configurations shown in FIG. 1, which are other than that of the edge 30, are the same as those of the speaker of the first embodiment. Therefore, for the purpose of simplifying the explanation, the same constituent portions as those of the first embodiment are described while being assigned with the same reference numerals.

As shown in FIG. 5, the edge 30 is an annular elastic deformation member that couples the diaphragm 2 and the frame 1 to each other so that the diaphragm 2 and the frame 1 can be freely deformable.

The edge 30 functions as a suspension that supports the diaphragm 2.

Moreover, the edge 30 includes: a circular arc portion 31 having a circular arc cross-sectional shape protruded to the sound emission side; an edge inner circumferential portion 37, which is formed on one end side of the circular arc portion 31 and is connected to the outer circumferential portion of the diaphragm 2; and an edge outer circumferential portion 38, which is formed on the other end side of the circular arc portion 31 and is connected to the frame 1. In a vicinity of the edge outer circumferential portion 38 in an inner recessed surface 32 of the circular arc portion 31, a rib 33 protruding in the opposite direction to the sound emission direction is formed.

The circular arc portion 31, the rib 33, the edge inner circumferential portion 37 and the outer circumferential portion 38 can be fabricated by integrally molding an elastic deformation member common thereto.

The rib 33 may be formed into an annular shape along the annular edge 30 over an entire circumference thereof, or may be intermittently formed only on specific locations going along the annular edge 30.

When the diaphragm 2 is displaced in the opposite direction to the sound emission direction, a stress is concentrated on a connection spot 34 of the edge 30 to the circular arc portion 31 on an inner circumferential side of the rib 33, and accordingly, the edge 30 is deformed around the connection spot 34 serving as a fulcrum, and a tip end portion of the rib 33 makes contact with an inner side surface 35 of the edge outer circumferential portion 38 in a vicinity thereof. In such a way, it is possible to limit the stroke in the opposite direction to the sound emission direction.

Moreover, since the rib 33 is made of an elastic deformation member, a tip end portion of the rib 33 is gradually deformed as the diaphragm 2 is vibrating in the opposite direction to the sound emission direction, whereby it is possible to gradually limit the stroke in the opposite direction to the sound emission direction.

Meanwhile, when the diaphragm 2 is displaced in the sound emission direction, the stress is concentrated on a connection spot 36 between the circular arc portion 31 of the edge 10 and the frame 1, and accordingly, the edge 30 is deformed around the connection spot 36 serving as a fulcrum. Therefore, the edge 10 is deformed in a direction where such a tip end of the rib 33 separates from the inner side surface 35 of the edge outer circumferential portion 38.

Hence, in the case where the diaphragm 2 is displaced in the sound emission direction, the stroke in the sound emission direction is not affected by the limitations of the rib 33.

Hence, the above-mentioned modification example can also obtain similar effects to those of the first embodiment.

<Second Embodiment>

Figure 6:
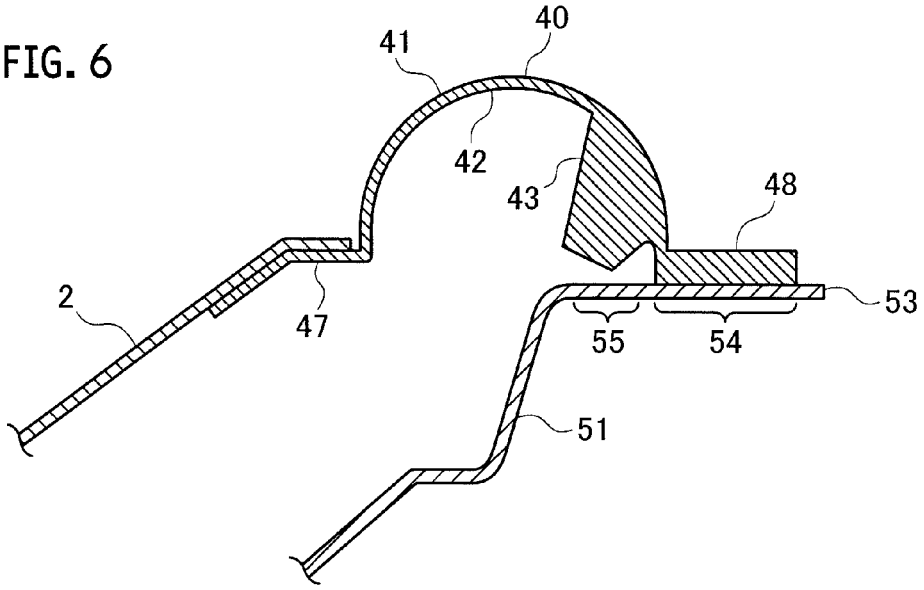
FIG. 6 is a cross-sectional view showing an edge in the speaker of the second embodiment.
Figure 7:
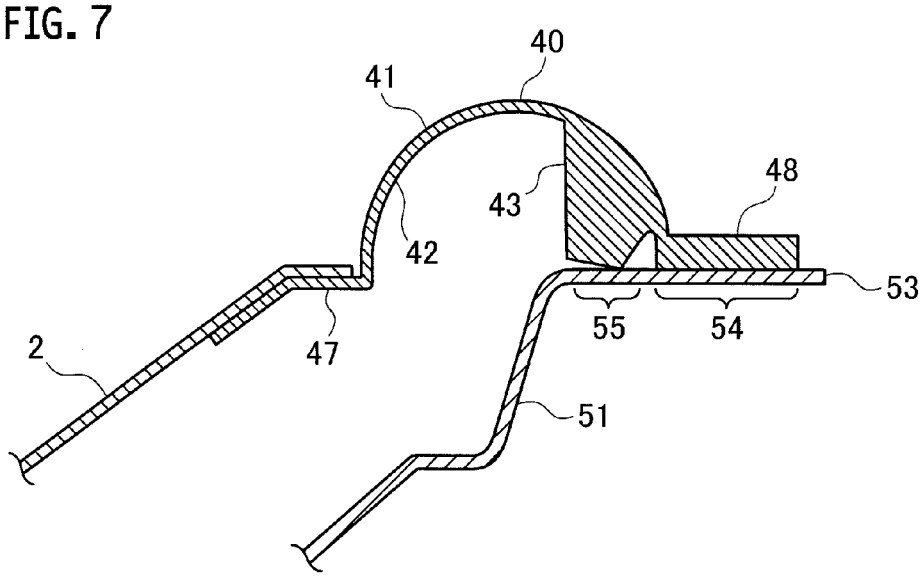
FIG. 7 is a cross-sectional view showing a deformed state of the edge when a diaphragm shown in FIG. 6 vibrates in the direction opposite to the sound emission direction.
Figure 8:
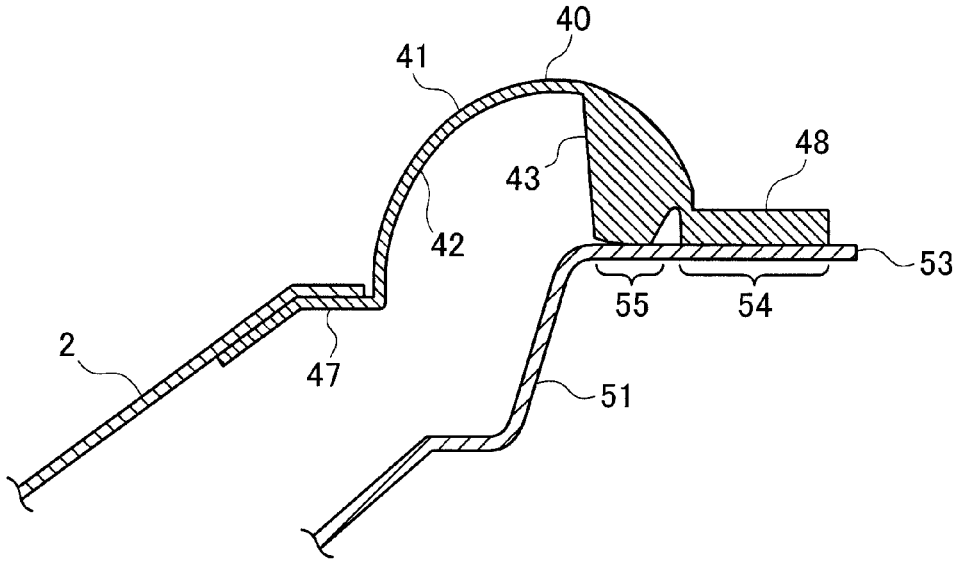
FIG. 8 is a cross-sectional view showing a deformed state of the edge when the diaphragm shown in FIG. 7 further vibrates in the direction opposite to the sound emission direction.

A description follows of a speaker of the second embodiment by using FIG. 6, FIG. 7 and FIG. 8. FIG. 6 and FIG. 8 correspond to FIG. 2 and FIG. 3 of the first embodiment, respectively.

In comparison with the speaker of the second embodiment, the speaker of the second embodiment is different therefrom in configurations of an edge 40 and a frame 51, and configurations shown in FIG. 1, which are other than those of the edge 40 and the frame 51, are the same as those of the speaker of the first embodiment. Therefore, for the purpose of simplifying the explanation, the same constituent portions as those of the first embodiment are described while being assigned with the same reference numerals.

As shown in FIG. 6, the edge 40 is an annular elastic deformation member that couples the diaphragm 2 and the frame 51 to each other so that the diaphragm 2 and the frame 51 can be freely deformable.

The edge 40 functions as a suspension that supports the diaphragm 2.

Moreover, the edge 40 includes: a circular arc portion 41 having a circular arc cross-sectional shape protruded to the sound emission side; an edge inner circumferential portion 47, which is formed on one end side of the circular arc portion 41 and is connected to the outer circumferential portion of the diaphragm 2; and an edge outer circumferential portion 48, which is formed on the other end side of the circular arc portion 41 and is connected to the frame 51. In a vicinity of the edge outer circumferential portion 48 in an inner recessed surface 42 of the circular arc portion 41, a rib 43 is formed, which is formed into a protrusion shape in the opposite direction to the sound emission direction, and is made thicker than the circular arc portion 41.

The circular arc portion 41, the rib 43, the edge inner circumferential portion 47 and the outer circumferential portion 48 can be fabricated by integrally molding an elastic deformation member common thereto.

The rib 43 may be formed into an annular shape along the annular edge 40 over an entire circumference thereof, or may be intermittently formed only on specific locations going along the annular edge 40.

On an outer edge portion 53 of the frame 51, the frame 51 includes: an edge connection region 54 to which the edge outer circumferential portion 48 of the edge 40 is connected; and a rib contact region 55 on which a tip end of the rib 43 makes contact when the diaphragm 2 vibrates in the opposite direction to the sound emission direction.

When the diaphragm 2 starts to be displaced in the opposite direction to the sound emission direction, the edge 40 starts to be deformed in a direction where the tip end of the rib 43 approaches the rib contact region 55 of the frame 51, and when the diaphragm 2 is further displaced in the opposite direction to the sound emission direction, then as shown in FIG. 7, a corner portion of the tip end of the rib 43 makes contact with the rib contact region 55 of the frame 51.

When the diaphragm 2 is further displaced in the opposite direction to the sound emission direction, then as shown in FIG. 8, the tip end of the rib 43 gradually makes contact with the rib contact region 55 of the frame 51 from the corner portion thereof. Since the rib 43 is made of an elastic deformation member, the rib 33 is deformed so that a contact area thereof with the frame 51 can become gradually larger as the diaphragm 2 is being displaced in the opposite direction to the sound emission direction. Therefore, it is possible to gradually limit the stroke in the opposite direction to the sound emission direction.

Meanwhile, in the case where the diaphragm 2 is displaced in the sound emission direction, the edge 40 is deformed in a direction where the tip end of the rib 43 separates from the rib contact region 55 of the frame 51.

Hence, in the case where the diaphragm 2 vibrates in the sound emission direction, the stroke in the sound emission direction is not affected by the limitations of the rib 43.

In accordance with the second embodiment, the thick rib 43 is gradually elastically deformed, and thereby limits the stroke in the opposite direction to the sound emission direction, and accordingly, damage to the edge 40, which is caused by the frame 51, can be suppressed.

Hence, the second embodiment can also obtain the similar effects to those of the first embodiment.

<Third Embodiment>

Figure 9:
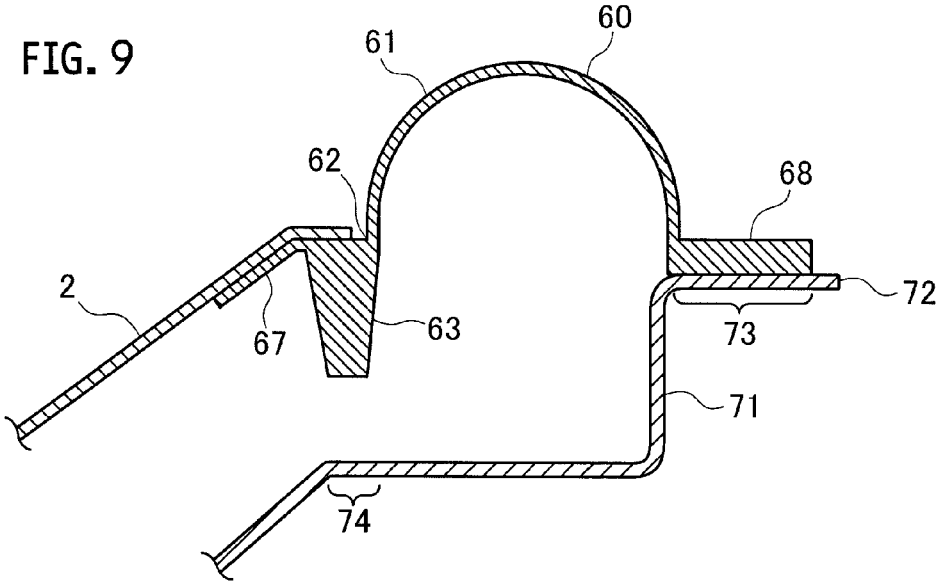
FIG. 9 is a cross-sectional view showing an edge in the speaker of the third embodiment.
Figure 10:
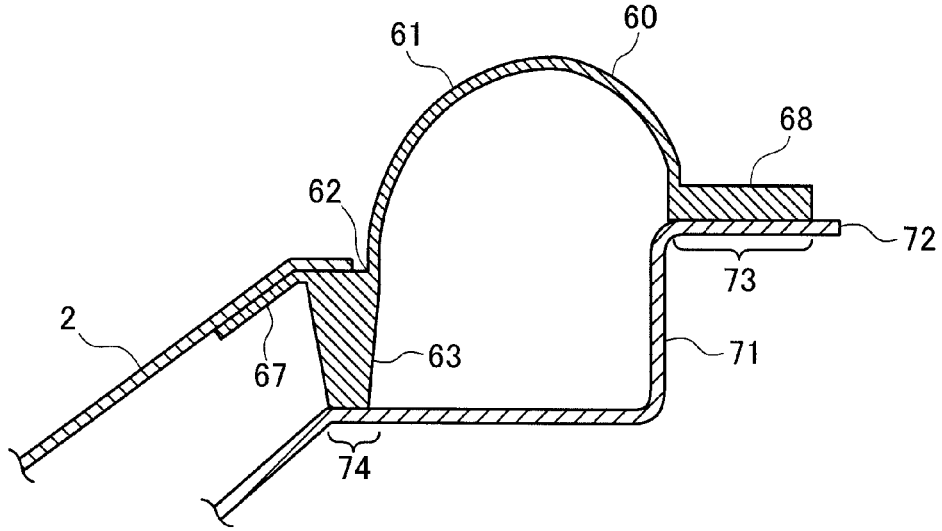
FIG. 10 is a cross-sectional view showing a deformed state of the edge when a diaphragm shown in FIG. 9 vibrates in the direction opposite to the sound emission direction.

A description follows of a speaker of the third embodiment by using FIG. 9 and FIG. 10. FIG. 9 and FIG. 10 correspond to FIG. 2 and FIG. 3 of the first embodiment, respectively.

In comparison with the speaker of the first embodiment, the speaker of the third embodiment is different therefrom in configurations of an edge 60 and a frame 71, and configurations shown in FIG. 1 which, other than those of the edge 60 and the frame 71, are the same as those of the speaker of the first embodiment. Therefore, for the purpose of simplifying the explanation, the same constituent portions as those of the first embodiment are described while being assigned with the same reference numerals.

As shown in FIG. 9, the edge 60 is an annular elastic deformation member that couples the diaphragm 2 and the frame 71 to each other so that the diaphragm 2 and the frame 71 can be freely deformable.

The edge 60 functions as a suspension that supports the diaphragm 2, and in addition, has a damping function to suppress divided vibrations of the diaphragm 2.

Moreover, the edge 60 includes: a circular arc portion 61 having a circular arc cross-sectional shape protruded to the sound emission side; an edge inner circumferential portion 67, which is formed on one end side of the circular arc portion 61 and is connected to the outer circumferential portion of the diaphragm 2; and an edge outer circumferential portion 68, which is formed on another end side of the circular arc portion 61 and is connected to the frame 71. In a vicinity of an inner edge portion 62 of the circular arc portion 61 and the edge inner circumferential portion 67, a rib 63 is formed, which is formed into a protrusion shape in the opposite direction to the sound emission direction, and is made thicker than the circular arc portion 61.

The circular arc portion 61, the rib 63, the edge inner circumferential portion 67 and the outer circumferential portion 68 can be fabricated by integrally molding an elastic deformation member common thereto.

The rib 63 is connected to the outer circumferential portion of the diaphragm 2 together with the edge inner circumferential portion 67.

Moreover, the rib 63 may be formed into an annular shape along the annular edge 60 over an entire circumference thereof, or may be intermittently formed only on specific locations going along the annular edge 60.

On an outer edge portion 72 of the frame 71, the frame 71 has an edge connection region 73 to which the edge outer circumferential portion 68 of the edge 60 is connected. Moreover, the frame 71 includes a rib contact region 74 which the tip end of the rib 63 makes contact when the diaphragm 2 vibrates in the opposite direction to the sound emission direction.

When the diaphragm 2 starts to be displaced in the opposite direction to the sound emission direction, the edge 60 starts to be deformed in a direction where the tip end of the rib 63 approaches the rib contact region 74 of the frame 71, and when the diaphragm 2 is further displaced in the opposite direction to the sound emission direction, then as shown in FIG. 10, the tip end of the rib 63 makes contact with the rib contact region 74 of the frame 71. In such a way, it is possible to limit the stroke in the opposite direction to the sound emission direction.

Meanwhile, in the case where the diaphragm 2 is displaced in the sound emission direction, the edge 60 is deformed in a direction where the tip end of the rib 63 separates from the rib contact region 74 of the frame 71.

Hence, in the case where the diaphragm 2 vibrates in the sound emission direction, the stroke in the sound emission direction is not affected by the limitations of the rib 63.

In accordance with the third embodiment, when limiting the stroke in the opposite direction to the sound emission direction, the thick rib 63 makes contact with the frame 71, and the rib 63 is held by the diaphragm 2, and accordingly, damage of the edge 60, which is caused by the frame 71, can be suppressed.

Moreover, in the third embodiment, the rib 63 is arranged at a position where the rib 63 makes contact with the diaphragm 2. Therefore, when the diaphragm 2 vibrates in the opposite direction to the sound emission direction, the rib 63 moves along the opposite direction to the sound emission direction. Accordingly, it is also possible to emit a sound, for example, when the tip end of the rib 63 makes contact with the rib contact region 74 of the frame 71; a user's attention can be called by sound generation.

<Modification Example of Third Embodiment>

Figure 11:
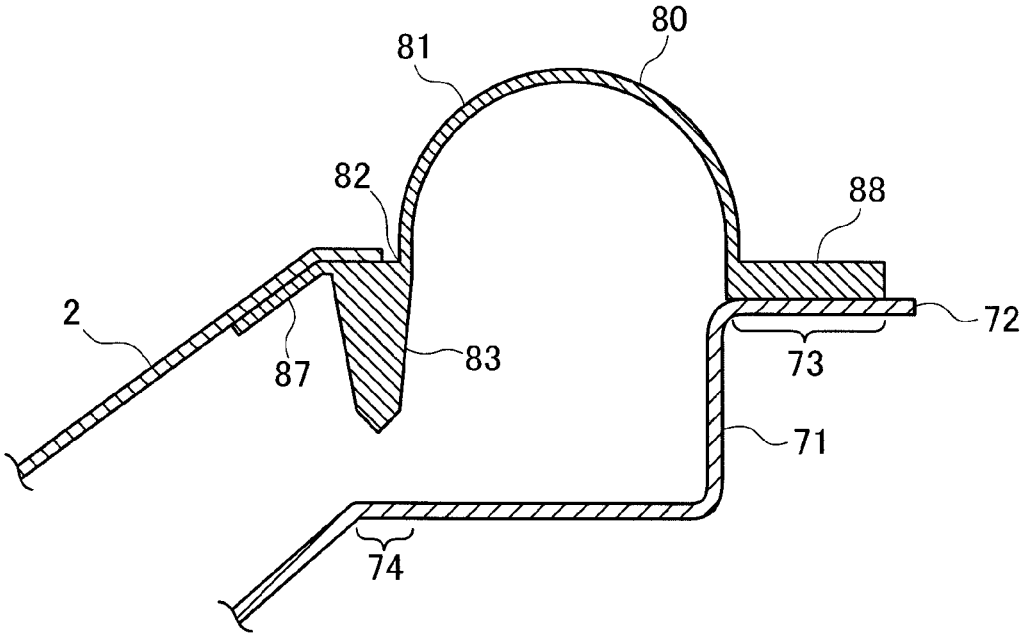
FIG. 11 is a cross-sectional view showing a modification example of the edge in the speaker of the third embodiment.

A description follows of a modification example of the edge in the speaker of the third embodiment. FIG. 11 corresponds to FIG. 9 in the third embodiment.

In comparison with the speaker of the third embodiment, a speaker of this modification example is different therefrom in configuration of an edge 80, and configurations shown in FIG. 1 and FIG. 9, which are other than those of the edge 80, are the same as those of the speaker of the first embodiment. Therefore, for the purpose of simplifying the explanation, the same constituent portions as those of the third embodiment are described while being assigned with the same reference numerals.

As shown in FIG. 11, the edge 80 is an annular elastic deformation member that couples the diaphragm 2 and the frame 71 to each other so that the diaphragm 2 and the frame 71 can be freely deformable.

The edge 80 functions as a suspension that supports the diaphragm 2.

Moreover, the edge 80 includes: a circular arc portion 81 having a circular arc cross-sectional shape protruded to the sound emission side; an edge inner circumferential portion 87, which is formed on one end side of the circular arc portion 81 and is connected to the outer circumferential portion of the diaphragm 2; and an edge outer circumferential portion 88, which is formed on the other end side of the circular arc portion 81 and is connected to the frame 71. In a vicinity of an inner edge portion 82 of the circular arc portion 81 and the edge inner circumferential portion 87, a rib 83 is formed into a protrusion shape in the opposite direction to the sound emission direction, and is made thicker than the circular arc portion 81.

The circular arc portion 81, the rib 83, the edge inner circumferential portion 87 and the outer circumferential portion 88 can be fabricated by integrally molding an elastic deformation member common thereto.

The rib 83 is connected to the outer circumferential portion of the diaphragm 2 together with the edge inner circumferential portion 87.

Moreover, the rib 83 may be formed into an annular shape along the annular edge 80 over an entire circumference thereof, or may be intermittently formed only on specific locations going along the annular edge 80.

In the third embodiment, the tip end of the rib 63 is a flat surface. On the contrary, in this modification example, a cross-sectional shape of a tip end of the rib 83 is set to be a triangular shape protruded toward the rib contact region 74 of the frame 71.

Therefore, in this modification example, in comparison with the third embodiment, when the diaphragm 2 is displaced in the opposite direction to the sound emission direction, the rib 83 gradually makes contact with the rib contact region 74 of the frame 71 from a tip end of the triangular shape. Since the rib 83 is made of an elastic deformation member, the rib 83 is deformed so that the contact area thereof with the frame 71 can be gradually larger as the diaphragm 2 is being displaced in the opposite direction to the sound emission direction. Therefore, it is possible to gradually limit the stroke in the opposite direction to the sound emission direction.

Note that the embodiments according to the present invention are not limited to the above-mentioned configurations, and are changeable in various ways within the scope without departing from the scope of the present invention. It is possible to adopt a configuration in which the first embodiment and the third embodiment are combined with each other, and it is also possible to adopt a configuration in which the second embodiment and the third embodiment are combined with each other.

What is claimed is:

1. A speaker comprising:

a diaphragm;

an edge, which has an inner circumferential portion connected to an outer circumferential portion of the diaphragm, and is made of an annular elastic deformation member;

a frame, which is connected to an outer circumferential portion of the edge, and supports the diaphragm through the edge;

a magnetic circuit, which displaces the diaphragm in a first direction that is a sound emission direction and in a second direction that is an opposite direction to the sound emission direction, and vibrates the diaphragm, and at least one rib, which is provided on a back side of the edge and in a region between the inner circumferential portion and outer circumferential portion of the edge, the back side being a side facing the second direction, the at least one rib protruding in the second direction from the back side, and the at least one rib being configured to limit a stroke of the diaphragm in the second direction when the diaphragm is displaced in the second direction.

2. The speaker according to claim 1, wherein, as the rib, a plurality of ribs arrayed in line in a radial direction of the edge is provided, and when the diaphragm is displaced in the second direction, the edge is deformed so that the plurality of ribs makes contact with one another, and when the diaphragm is displaced in the first direction, the edge is deformed so that the plurality of ribs separates from one another.

3. The speaker according to claim 2, wherein the plurality of ribs is configured so that a degree of limiting the stroke of the diaphragm is greater as a degree at which the diaphragm is displaced in the second direction becomes greater.

4. The speaker according to claim 1, wherein the frame includes a rib contact region which the rib makes contact when the diaphragm is displaced in the second direction.

5. The speaker according to claim 4, wherein the rib is configured so that an area which makes contact with the rib contact region becomes larger as the degree at which the diaphragm is displaced in the second direction becomes greater.

* * * * *